US008947068B2

(12) United States Patent
Tao

(10) Patent No.: US 8,947,068 B2
(45) Date of Patent: Feb. 3, 2015

(54) CONTROL CIRCUIT EMPLOYING FOLLOWER CIRCUIT TO CONTROL REFERENCE SIGNAL AND RELATED CIRCUIT CONTROL METHOD

(75) Inventor: Cheng Tao, He Fei (CN)

(73) Assignee: MediaTek Singapore Pte. Ltd., Singapore (SG)

( * ) Notice: Subject to any disclaimer, the term of this patent is extended or adjusted under 35 U.S.C. 154(b) by 400 days.

(21) Appl. No.: 13/539,508

(22) Filed: Jul. 2, 2012

(65) Prior Publication Data

US 2013/0076319 A1 Mar. 28, 2013

(30) Foreign Application Priority Data

Sep. 27, 2011 (CN) ..... 2011 1 0295640

(51) Int. Cl.
*G05F 3/16* (2006.01)
*G05F 3/26* (2006.01)

(52) U.S. Cl.
CPC ..... *G05F 3/267* (2013.01)
USPC ..... 323/315

(58) Field of Classification Search
USPC ..... 323/312, 313, 314, 315
See application file for complete search history.

(56) References Cited

U.S. PATENT DOCUMENTS 5,317,279 A 5/1994 Zarabadi
5,760,639 A * 6/1998 Hall ..... 327/539
7,173,481 B2 * 2/2007 Kimura ..... 327/541
2003/0025536 A1 2/2003 Mandrini
2009/0085550 A1 * 4/2009 Ide ..... 323/315
2011/0187344 A1 * 8/2011 Iacob et al. ..... 323/315
2013/0076319 A1 * 3/2013 Tao ..... 323/265
2014/0091780 A1 * 4/2014 Hu et al. ..... 323/314

OTHER PUBLICATIONS

Dualibe,C.;Petrashin,P.;Toledo,L.;Lancioni,W., "New Low-Voltage Electrically Tunable Triode-MOSFET Transconductor and its Application to Low-Frequency Gm-C Filtering," Integrated Circuits and Systems Design, 18th Symposium on, pp. 207-212, Sep. 4-7, 2005.

Mahmoud, Soliman A.;Awad,I.A., "New CMOS balanced output transconductor and application to GM-C biquad filter" Circuits and Systems, 2003. ISCAS '03. Proceedings of the 2003 International Symposium on, vol. 1, pp. I-385-1-388, vol. 1, May 25-28, 2003.

* cited by examiner

*Primary Examiner* — Jeffrey Sterrett
(74) *Attorney, Agent, or Firm* — Winston Hsu; Scott Margo

(57) ABSTRACT

A control circuit includes: a first current generating circuit arranged for generating at least one output current according to a reference signal; a second current generating circuit arranged for generating a reference current corresponding to the reference signal according to the reference signal; and a follower circuit coupled to the second current generating circuit for generating a control current according to the reference current, and feeding back the control current to the first current generating circuit from the second current generating circuit in a signal-following manner to control the reference signal.

17 Claims, 4 Drawing Sheets

CONTROL CIRCUIT EMPLOYING FOLLOWER CIRCUIT TO CONTROL REFERENCE SIGNAL AND RELATED CIRCUIT CONTROL METHOD

BACKGROUND

The present invention relates to a control circuit and a related circuit control method, and more particularly, to a control circuit of a current source of a digital-to-analog converter and a related circuit control method.

In an electronic device system, a digital-to-analog converter is arranged for converting a digital signal to an analog signal. For example, when a processor generates a digital video signal, the digital-to-analog converter converts the digital video signal to the analog video signal to be displayed on a monitor. However, as technology evolves, the data amount and the data rate of the digital video signal increase quickly, so that the operating speed and the stability of the digital-to-analog converter should be correspondingly enhanced. In other words, when the digital-to-analog converter converts the digital video signal to the analog video signal, the current source of the digital-to-analog converter must be maintained at a stable state to provide accurate current to the digital-to-analog converter. Therefore, how to design a current source of a digital-to-analog converter by using a cheap and effective way is a significant concern in this field.

SUMMARY

According to a first embodiment of the present invention, a control circuit is provided. The control circuit includes a first current generating circuit, a second current generating circuit and a follower circuit. The first current circuit is arranged for generating at least one output current according to a reference signal. The second current generating circuit is arranged for generating a reference current corresponding to the output current according to the reference signal. The follower circuit is coupled to the second current generating circuit to generate a control current according to the reference current, and feeds back the control current to the first current generating circuit from the second current generating circuit in a signal-following manner to control the reference signal.

According to a second embodiment of the present invention, a circuit control method is provided. The circuit control method includes: generating at least one output current according to a reference signal; generating a reference current corresponding to the output current according to the reference signal; and generating a control current according to the reference current, and feeding back the control current in a signal-following manner to control the reference signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . .". Also, the term "couple" is intended to mean either an indirect or direct electrical connection. Accordingly, if one device is coupled to another device, that connection may be through a direct electrical connection, or through an indirect electrical connection via other devices and connections.

Figure 1:
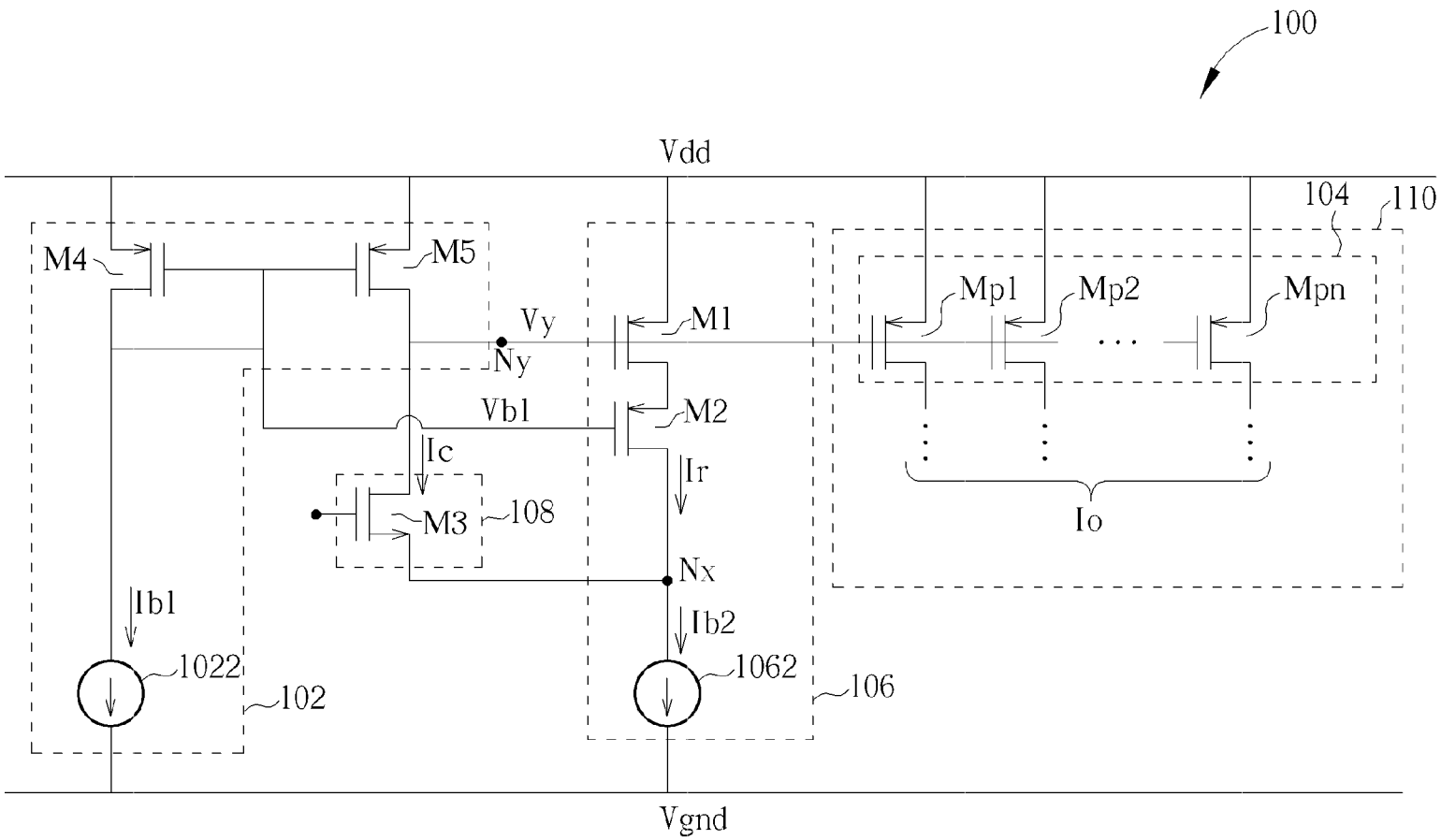
FIG. 1 is a diagram illustrating a control circuit according to an embodiment of the present invention.

Please refer to FIG. 1, which is a diagram illustrating a control circuit 100 according to an embodiment of the present invention. In this embodiment, the control circuit 100 includes a reference signal generating circuit 102, a first current generating circuit 104, a second current generating circuit 106 and a follower circuit 108. The first current generating circuit 104 is arranged for generating an output current Io according to a reference signal Vy. The second current generating circuit 106 is arranged for generating a reference current Ir corresponding to the output current Io according to the reference signal Vy. The follower circuit 108 is coupled to the second current generating circuit 106, and arranged to generate a control current Ic according to the reference current Ir and feed back the control current Ic to the first current generating circuit 104 from the second current generating circuit 106 in a signal-following manner to control the reference signal Vy. The reference signal generating circuit 102 is coupled to the first current generating circuit 104, the second current generating circuit 106 and the follower circuit 108, and arranged for generating the reference signal Vy. Please note that an embodiment of the present invention utilizes control circuit 100 to control the current source of a digital-to-analog converter, therefore, the first current generating circuit 104 in FIG. 1 may be considered as part of a current source array 110 of the digital-to-analog converter. In addition, the reference signal Vy may be considered as a voltage signal for brevity.

The first current generating circuit 104 includes a plurality of P-type field effect transistors Mp1-Mpn, each generating an output current according to the reference signal Vy. The output current Io mentioned above is the sum of the output currents generated by the P-type field effect transistor Mp1-Mpn for brevity.

The second current generating circuit 106 includes a P-type field effect transistor M1, a P-type field effect transistor M2 and a reference current source 1062. The P-type field effect transistor M1 has a control terminal (i.e., a gate terminal, the same for other transistors mentioned below) Ny coupled to the reference signal Vy, a first connection terminal (i.e., a source terminal, the same for other transistors mentioned below) coupled to a first reference voltage Vdd, and a second connection terminal (i.e., a drain terminal, the same for other transistors mentioned below) arranged for outputting the reference current Ir. Similarly, the P-type field effect transistor M2 has a control terminal coupled to a bias voltage Vb1, a first connection terminal coupled to the second connection terminal of the P-type field effect transistor M2, and a second connection terminal Nx coupled to the first terminal of the reference current source 1062 to provide the reference current Ir. The second terminal of the reference current source 1062 is coupled to a second reference voltage Vgnd, and the reference current source 1062 is arranged for generating a constant current Ib2. Moreover, in this embodiment, the first reference voltage Vdd is a supply voltage, and the second reference voltage Vgnd is a ground voltage.

The follower circuit 108 includes an N-type field effect transistor M3 having a control terminal coupled to a bias voltage Vb2, a first connection terminal coupled to the reference current (i.e., the second connection terminal Nx), and a second connection terminal (i.e. the control terminal Ny) arranged for generating the control current Ic. In this embodiment, the N-type field effect transistor M3 is a common gate N-type field effect transistor. More specifically, the bias voltage Vb2 at the control terminal of the N-type field effect transistor M3 may be configured to maintain the operating region of the N-type field effect transistor M3 in a saturation region. Therefore, signal variation at the first connection terminal of the N-type field effect transistor M3 would be present in the signal (e.g., the control current Ic) at the second connection terminal of the N-type field effect transistor M3, thus achieving the signal-following mechanism.

The reference signal generating circuit 102 includes a P-type field effect transistor M4, a reference current source 1022 and a P-type field effect transistor M5. The P-type field effect transistor M4 has a first connection terminal coupled to the first reference voltage Vdd, and a control terminal coupled to a second connection terminal of the P-type field effect transistor M4 to output the bias voltage Vb2. The reference current source 1022 has a first terminal coupled to the second connection terminal of the P-type field effect transistor M4 and a second terminal coupled to the second reference voltage Vgnd, and is arranged for generating a constant current Ib1. The P-type field effect transistor M5 has a first connection terminal coupled to the first reference voltage Vdd, a control terminal coupled to the control terminal of the P-type field effect transistor M4 and a first connection terminal (i.e., the control terminal Ny) used to output the reference signal Vy.

When the control circuit 100 is in a normal operating state, the reference signal generating circuit 102 generates the reference signal Vy and the bias voltage Vb1 to the first current generating circuit 104 and the second current generating circuit 106, respectively. The first current generating circuit 104 generates the output current Io to the digital-to-analog converter according to the reference signal Vy, and the second current generating circuit 106 generates the reference current Ir according to the reference signal Vy and the bias voltage Vb1. In this embodiment, as the reference current source 1062 is arranged for generating a constant current Ib2, the current difference between the reference current Ir and the current Ib2 flows through the follower circuit 108 to generate the control current Ic for feedback control of the reference signal Vy. For example, when the voltage level of the reference signal Vy raises, the reference current Ir reduces correspondingly. When the control current Ic raises, the voltage level of the reference signal Vy of the control terminal Ny reduces correspondingly. In this way, the output current Io can remain unchanged.

Besides, when the control circuit 100 is in the normal operating state to provide the output current Io to the digital-to-analog converter, the capacitance C1 of a first capacitor and the resistance R1 of a first resistor both viewed by the first connection terminal (i.e., the second connection Nx) of the N-type field effect transistor M3 are respectively less than the capacitance C2 of a second capacitor and the resistance R2 of a second resistor both viewed by the first connection terminal (i.e., the second connection Nx) of the P-type field effect transistor M5. More specifically, when the N-type field effect transistor M3 is in the saturation region, the capacitance C1 of the second connection terminal Nx is approximately equal to the summation of the capacitance of the drain terminal of the P-type field effect transistor M2, the capacitance of the source terminal of the N-type field effect transistor M3, and the capacitance of the output terminal of the reference current source 1062. The capacitance C2 of the control terminal Ny is approximately equal to the summation of the capacitance of the drain terminal of the P-type field effect transistor M5, the capacitance of the drain terminal of the N-type field effect transistor M3, and the capacitance of gate terminals of the P-type field effect transistor M1 and the P-type field effect transistors Mp1-Mpn. Therefore, the capacitance C1 would be less than the capacitance C2. On the other hand, the resistance R1 of the second connection terminal Nx is approximately equal to the parallel-connection resistance of the output resistance looking into the drain terminal of the P-type field effect transistor and the resistance looking into the source terminal of the N-type field effect transistor (i.e., the reciprocal of the transconductance of the N-type field effect transistor M3, namely 1/gm). The resistance R2 of the control terminal Ny is approximately equal to the parallel-connection resistance of the output resistance looking into the drain terminal of the P-type field effect transistor M5 and the output resistance looking into the drain terminal of the N-type field effect transistor M3. Accordingly, the resistance R1 would be less than the resistance R2.

Figure 2:
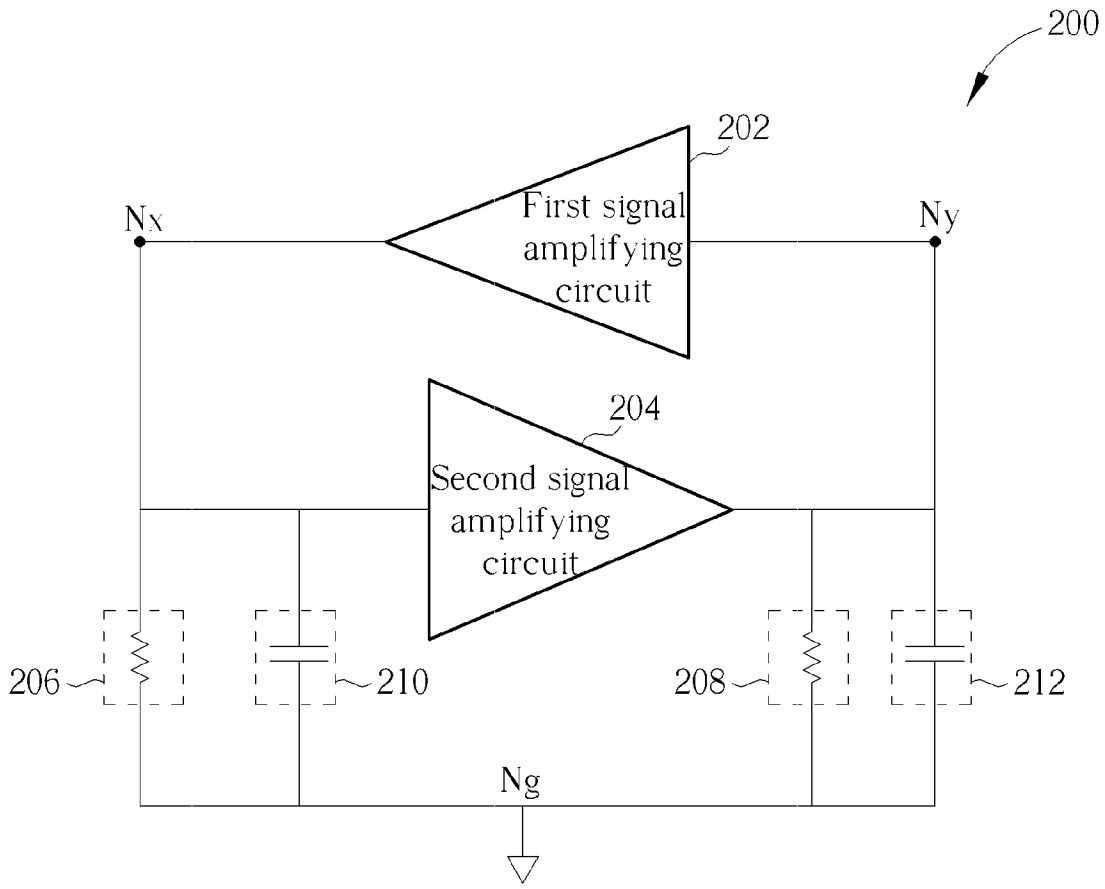
FIG. 2 is a diagram illustrating an AC signal circuit of the control circuit in the normal operating state according to an embodiment of the present invention.

Furthermore, please refer to FIG. 2, which is a diagram illustrating an AC signal (i.e., a small signal) circuit 200 of the control circuit 100 operating in the normal operating state according to an embodiment of the present invention. The AC signal circuit 200 includes a first signal amplifying circuit 202, a second signal amplifying circuit 204, a first equivalent resistor 206, a second equivalent resistor 208, a first equivalent capacitor 210 and a second equivalent capacitor 212. The output terminal of the first signal amplifying circuit 202 is coupled to the input terminal of the second signal amplifying circuit 204, i.e., the second connection terminal Nx. The output terminal of the second signal amplifying circuit 204 is coupled to the input terminal of the first signal amplifying circuit 202, i.e., the control terminal Nx. The first equivalent resistor 206 is the equivalent resistor viewed by the second connection terminal Nx, and the resistance thereof is R1. The second equivalent resistor 208 is the equivalent resistor viewed by the control terminal Ny, and the resistance thereof is R2. The first equivalent capacitor 210 is the equivalent capacitor viewed by the second connection terminal Nx, and the capacitance thereof is C1. The second equivalent capacitor 212 is the equivalent capacitor viewed by the control terminal Ny, and the capacitance thereof is C2. Moreover, the AC signal circuit 200 has a virtual ground terminal Ng coupled to the first equivalent resistor 206, the second equivalent resistor 208, the first equivalent capacitor 210 and the second equivalent capacitor 212.

The first signal amplifying circuit 202 represents an equivalent transconductance amplifying circuit formed by the P-type field effect transistor M1 and the P-type field effect transistor M2 of the control circuit 100, and the second signal amplifying circuit 204 represents an equivalent common gate amplifier formed by the P-type field effect transistor M1 and the N-type field effect transistor M3 of the control circuit 100.

Accordingly, the two main poles of the AC signal circuit 200 can be obtained through the pole analysis of the AC signal circuit 200, where the first pole frequency P1 and the second pole frequency P1 can be represented by following equations (1) and (2):

$$P1=-1/(R2*C2), \quad (1)$$

$$P2=-1/(R1*C1). \quad (2)$$

As can be readily known from the above description pertinent to the control circuit 100, the capacitance C2 of the second capacitor and the resistance R2 of the second resistor are larger than the capacitance C1 of the first capacitor and the resistance R1 of the first resistor, respectively. Thus the product of the capacitance C2 of the second capacitor and the resistance R2 of the second resistor is much larger than the product of the capacitance C1 of the first capacitor and the resistance R1 of the first resistor. In other word, if we ignore the negative sign in equations (1) and (2), the first pole frequency P1 will be far lower than the second pole frequency P2. More specifically, the control circuit 100 of the present invention can widen the pole frequency difference of the two main poles without the use of the conventional frequency compensation method, thereby making the control circuit 100 operate in the normal operating state stably.

Figure 3A:
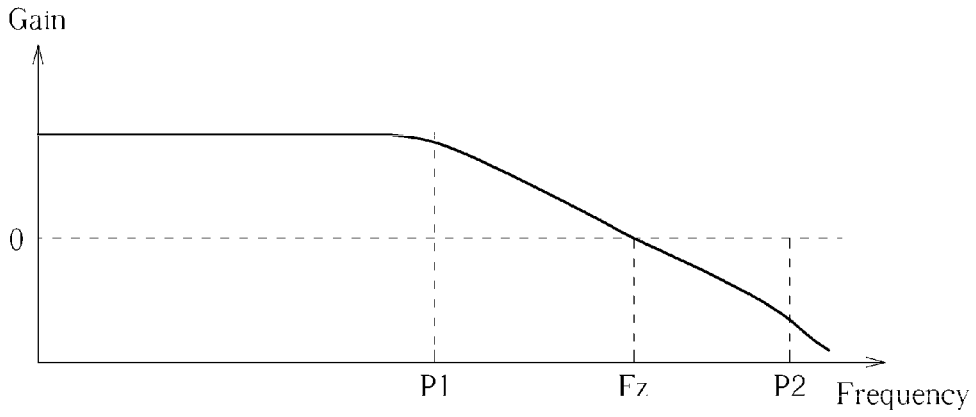
FIG. 3A is a diagram illustrating the characteristic curve of the relationship between a loop gain and the frequency of the AC signal circuit 200 according to the present invention.
Figure 3B:
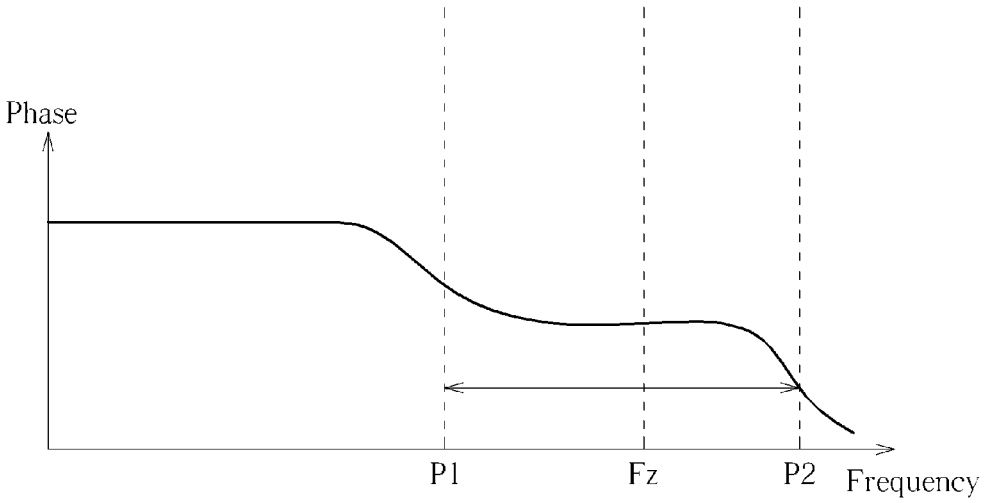
FIG. 3B is a diagram illustrating the characteristic curve of the relationship between a phase and the frequency of the AC signal circuit 200 according to the present invention.

Please refer to FIG. 3A and FIG. 3B. FIG. 3A is a diagram illustrating the characteristic curve of the relationship between a loop gain and a frequency of the AC signal circuit 200 according to the present invention. FIG. 3B is a diagram illustrating the characteristic curve of the relationship between a phase and a frequency of the AC signal circuit 200 according to the present invention. As can be readily known from FIG. 3A and FIG. 3B, the first pole frequency P1 and the second pole frequency P2 will be located at an extremely low frequency and an extremely high frequency, respectively, and the frequency Fz corresponding to the loop gain of 0 is located between the first pole frequency P1 and the second pole frequency P2. In other words, the AC signal circuit 200 of the present invention will have excellent phase margin, thus the stability of the control circuit 100 will be increased greatly.

Figure 4:
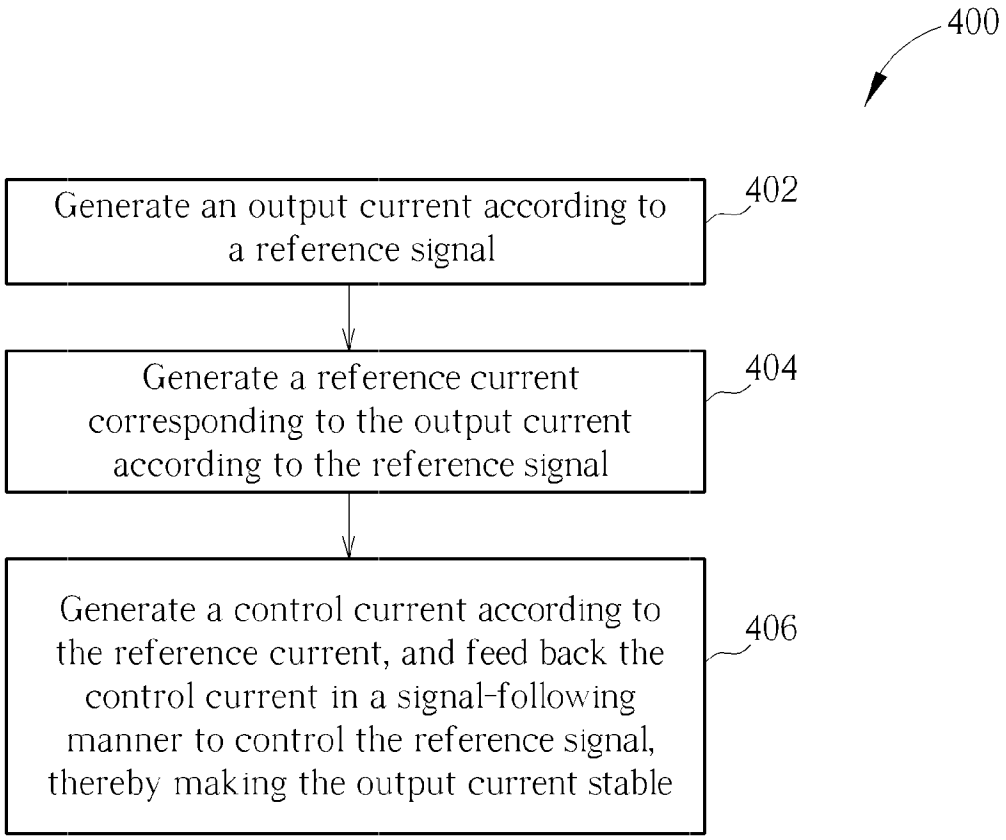
FIG. 4 is a diagram illustrating a circuit control method 400 according an embodiment of the present invention.

Please refer to FIG. 4, which is a diagram illustrating a circuit control method 400 according an embodiment of the present invention. The circuit control method 400 is utilized to control the current source of a digital-to-analog converter. In other words, the circuit control method 400 can be employed by the control circuit 100 of the present invention. For brevity and simplicity, the operating principle of the circuit control 400 is described with reference to the control circuit 100. However, this is not the only one embodiment of the circuit control method of the present invention. Provided that substantially the same result is achieved, the steps of the flowchart shown in FIG. 4 need not be in the exact order shown and need not be contiguous, that is, other steps can be intermediate. The circuit control method 400 includes following steps:

Step 402: Generate the output current Io according to the reference signal Vy;

Step 404: Generate the reference current Ir corresponding to the output current lo according to the reference signal Vy; and Step 406: Generate the control current Ic according to the reference current Ir, and feed back the control current Ic in a signal-following manner to control the reference signal Vy, thereby making the output current Io stable.

It can be known from FIG. 1 that the follower circuit 108 is implemented by the N-type field effect transistor M3, wherein the gate terminal of the N-type field effect transistor M3 is coupled to a bias voltage Vb2, the source terminal of the N-type field effect transistor M3 is coupled to the second connection terminal Nx, and the drain terminal of the N-type field effect transistor M3 is coupled to the control terminal Ny to generate the control current Ic. Therefore, the N-type field effect transistor M3 generates the control current Ic according to the reference current Ir, and feeds back the control current Ic in a signal-following manner to control the reference signal Vy, thereby making the output current Io stable (Step 406).

In summary, the control circuit 100 and the circuit control method of the embodiments use the follower circuit 108 to feed back the control current Ic in a signal-following manner for controlling the reference signal Vy. Besides, the stability of the control circuit 100 is enhanced by increasing the phase margin of the control circuit 100.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control circuit, comprising:

a first current generating circuit, arranged for generating at least one output current according to a reference signal;

a second current generating circuit, arranged for generating a reference current corresponding to the output current according to the reference signal; and a follower circuit, coupled to the second current generating circuit, for generating a control current according to the reference current, and feeding back the control current to the first current generating circuit from the second current generating circuit in a signal-following manner to control the reference signal.

2. The control circuit of claim 1, wherein the follower circuit comprises:

a field effect transistor, having a control terminal coupled to a bias voltage, a first connection terminal coupled to the reference current, and a second connection terminal utilized to output the control current.

3. The control circuit of claim 2, wherein the field effect transistor is a common gate field effect transistor.

4. The control circuit of claim 2, wherein the field effect transistor is an N-type field effect transistor.

5. The control circuit of claim 2, wherein a capacitance of a first capacitor and a resistance of a first resistor both viewed by the second connection terminal of the field effect transistor are larger than a capacitance of a second capacitor and a resistance of a second resistor both viewed by the first connection terminal of the field effect transistor, respectively.

6. The control circuit of claim 1, wherein the second current generating circuit comprises:

a first field effect transistor, having a control terminal coupled to the reference signal, a first connection terminal coupled to a first reference voltage, and a second connection terminal utilized to output the reference current; and a first reference current source, having a first terminal coupled to the second connection terminal of the first field effect transistor and a second terminal coupled to a second reference voltage, for generating a first constant current.

7. The control circuit of claim 6, wherein the first field effect transistor is a P-type field effect transistor.

8. The control circuit of claim 6, wherein the follower circuit comprises:

a second field effect transistor, having a control terminal coupled to a bias voltage, a first connection terminal coupled to the second connection terminal of the first field effect transistor, and a second connection terminal utilized to output the control current.

9. The control circuit of claim 8, wherein the second field effect transistor is an N-type field effect transistor.

10. The control circuit of claim 6, wherein the second current generating circuit further comprises:

a second field effect transistor, having a control terminal coupled to a first bias voltage, a first connection terminal coupled to the second connection terminal of the first field effect transistor, and a second connection terminal coupled to the first terminal of the first reference current source to output the reference current.

11. The control circuit of claim 10, wherein the second field effect transistor is a P-type field effect transistor.

12. The control circuit of claim 10, wherein the follower circuit comprises:

a third field effect transistor, having a control terminal coupled to a second bias voltage, a first connection terminal coupled to the second connection terminal of the second field effect transistor, and a second connection terminal utilized to output the control current.

13. The control circuit of claim 12, wherein the third field effect transistor is an N-type field effect transistor.

14. The control circuit of claim 10, further comprising:

a reference signal generating circuit, coupled to the first current generating circuit and arranged to generate the reference signal and a second bias voltage.

15. The control circuit of claim 14, wherein the reference signal generating circuit comprises:

a third field effect transistor, having a first connection terminal coupled to the first reference voltage, and a control terminal coupled to a second connection terminal to output the first bias voltage;

a second reference current source, having a first terminal coupled to the second connection terminal of the third field effect transistor and a second terminal coupled to the second reference voltage, for generating a second constant current; and a fourth field effect transistor, having a first connection terminal coupled to the first reference voltage, a control terminal coupled to the control terminal of the third field effect transistor, and a first connection terminal utilized to output the reference signal.

16. The control circuit of claim 15, wherein the third field effect transistor and the fourth field effect transistor are both P-type field effect transistors.

17. A circuit control method, comprising:

generating at least one output current according to a reference signal;

generating a reference current corresponding to the output current according to the reference signal; and generating a control current according to the reference current, and feeding back the control current in a signal-following manner to control the reference signal.

* * * * *